United States Patent [19]

Schewe

[11] 4,138,071

[45] Feb. 6, 1979

[54] DUAL DRIVE FOR CONE WINDING

[75] Inventor: Richard A. Schewe, Loves Park, Ill.

[73] Assignee: Barber-Colman Company, Rockford, Ill.

[21] Appl. No.: 892,631

[22] Filed: Apr. 3, 1978

[51] Int. Cl.[2] ..... B65H 54/42; B65H 54/46

[52] U.S. Cl. ..... 242/18 DD; 242/18 PW

[58] Field of Search ..... 242/18 DD, 18 PW

[56] References Cited

U.S. PATENT DOCUMENTS

| | | | |
|---|---|---|---|
| 3,291,405 | 12/1966 | O'Brien | 242/18 DD |
| 3,408,011 | 10/1968 | Lenk et al. | 242/18 PW |
| 3,730,447 | 5/1973 | Franzen et al. | 242/18 PW |
| 4,055,311 | 10/1977 | Bock et al. | 242/18 DD |

*Primary Examiner*—Stanley N. Gilreath
*Attorney, Agent, or Firm*—A. Richard Koch

[57] ABSTRACT

Friction devices are provided for a conical package core in positions near the large end of the core and intermediate the ends of the core. A creeling tail is wound on the large end of the core while the drive near that end is effective to rotate the core. When the strand being wound is transferred to a traversing strand guide, the strand is moved to and fro along the rotating core to produce a helical winding of the strand over the core between the small end and the creeling tail. The strand coming between the core and the intermediate drive lifts the core out of engagement with the drive at the large end.

10 Claims, 2 Drawing Figures

DUAL DRIVE FOR CONE WINDING

BACKGROUND OF THE INVENTION

This invention concerns cone winding of a strand and especially the driving of a package core upon which the strand is being wound.

In winding a strand upon a conical package core, the large end of the cone rotates with a higher peripheral speed than the small end, producing a greater tension on the strand. The different tensions produce changes in the physical characteristics of some types of yarn, which changes are undesirable. The high tension at the wide end may result in breakage of the strand. It is common to drive the cone initially by a frictional engagement with the core intermediate its ends and later by engagement with the strands wound on the core at such driven position. The rate at which the strand is wound over that driven position is thus maintained constant. The rate at which the strand is wound over any other position along the length of the cone is also constant, but increases as the winding progresses toward the large end and decreases as the winding progresses toward the small end. In order to reduce the effect of such changes in the winding rate, various types of strand accumulators have been employed to store some of the strand when the winding rate is low at the small end of the cone and to release the stored strand when the winding rate is high at the larger end of the cone, thus maintaining the tension on the strand substantially constant. This is satisfactory when the strand is being traversed to produce a high helix angle, but it is ineffective to reduce the tension while a creeling tail is being wound on the large end of the cone.

SUMMARY OF THE INVENTION

According to this invention a conical package core is mounted for free rotation about its axis and in peripheral engagement with two frictional drives along a straight line on the conical surface. One drive is located near the large end of the cone — the second intermediate the ends. The first drive is effective to rotate an empty core, since the frictional force produced thereby is operable on a longer arm (radius of the cone) than that of the second drive. The creeling tail, being wound in a fixed position along the length of the core near the large end, but not under the first drive, is therefore wound at a fixed rate, so that the tension in the strand is constant. When the strand is later traversed between limits established by the small end of the cone at one end and by the nearer of the sides of both the first drive and the base bunch facing the small end of the cone, the strand, or strands, lying between the core and the second drive raise the core out of contact with the first drive and thus transfer the driving function to the second drive.

The drawings are for illustration only. Some features, such as the strand being wound on the cone, are exaggerated in order to more clearly demonstrate the operation. Only components essential to the operation are shown.

DESCRIPTION OF THE PREFERRED EMBODIMENT

The described embodiment is exemplary and is not intended to define the limits of the invention. Many modifications and substitutions will be obvious to those skilled in the art.

Figure 1:
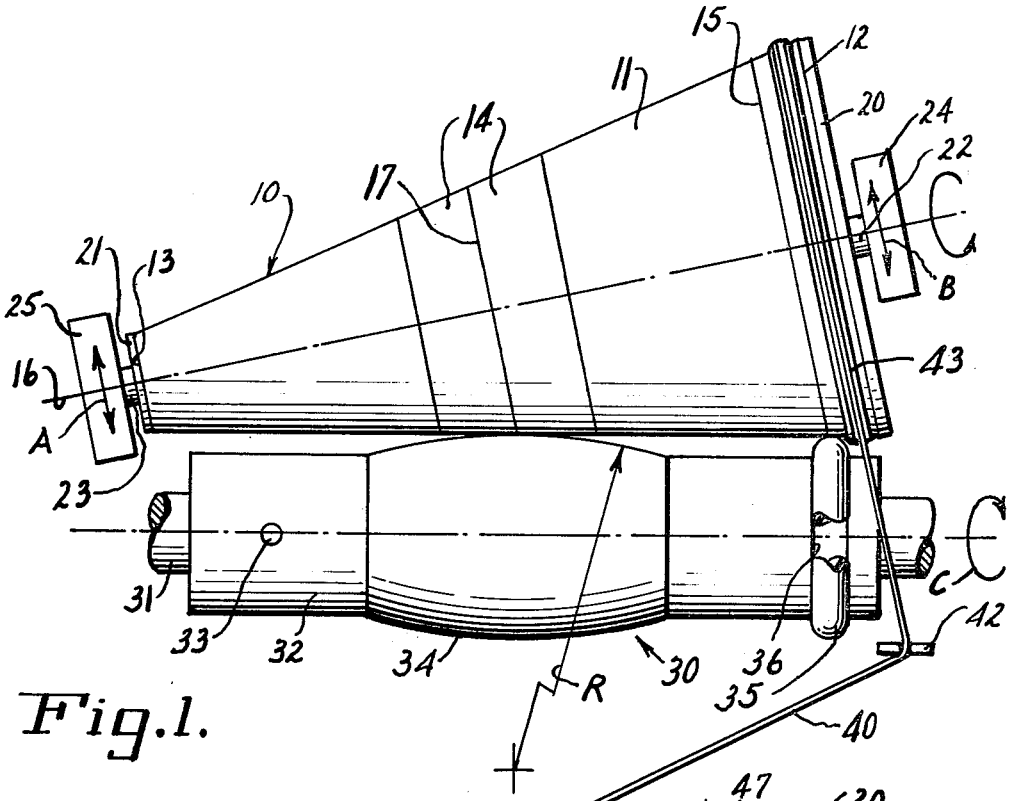
FIG. 1 is an elevation of the core, on which the creeling tail is being wound, in relation to the drive therefor.

As shown in FIG. 1, a cardboard package core 10 has a conical surface 11 between a large end 12 and a small end 13. Intermediate the ends 12, 13 on the conical surface 11 is an annular medial portion 14 to the described later. Near the large end 12 on the conical surface 11 is an annular end portion, shown as a contact line 15, to be described later. The core 10 is retained between cups 20, 21 engaging ends 12, 13 respectively. The cups have concentric stubs 22, 23 thereon, which are journaled for free rotation in spaced arms 24, 25 capable of oscillating as a unit about an axis (not shown) substantially parallel to and behind axis 16 about which the core 10 rotates, to that the core is movable laterally in the direction of the arrows A, B. The weight of the arms 24, 25 and other components supported thereby, biases the core 10 toward a drive mechanism 30.

The drive mechanism 30 comprises a drive shaft 31 substantially parallel to a generatrix of the conical surface 11 and rotatable in the direction of arrow C by means not shown. A sleeve 32, concentric with and held rigidly on shaft 31, as by pin 33, has two raised annular drive surfaces 34, 35 concentric thereon. The drive surface 34 is located on the sleeve so that it makes contact with the conical surface 11 within medial portion 14. It has a radius of curvature R to reduce scuffing by theoretically maintaining contact with core 10 only along contact line 17 within medial portion 14. The radius of curvature R is large for reasons to be explained later. The drive surface 34 is made of urethane molded onto the sleeve 32. The drive surface 35 is a synthetic rubber O-ring retained in position by a groove 36 in sleeve 32. The groove is located such that the O-ring makes contact with the core 10 only in the end portion 15, which theoretically is only a line. The maximum diameters of the drive surfaces, at which contact is made with the core, are substantially equal.

Initially the core 10 rests upon both drive surfaces 34, 35. When the drive shaft 31 is rotated, the drive surfaces rotate with the shaft, so their peripheral speeds are the same. Since their lines of contact 15, 17 on core 10 form circles of different radii, it is obvious that the core at both circles cannot have the same peripheral speed. Because line 15 has the larger radius, the frictional force exerted by the drive surface 35, which acts on line 15, produces a greater torque than that produced by the frictional force exerted by drive surface 34, acting upon line 17. The result is that drive surface 34 slips along line 17, while drive surface 35 frictionally engages line 15 to rotate core 10.

Figure 2:
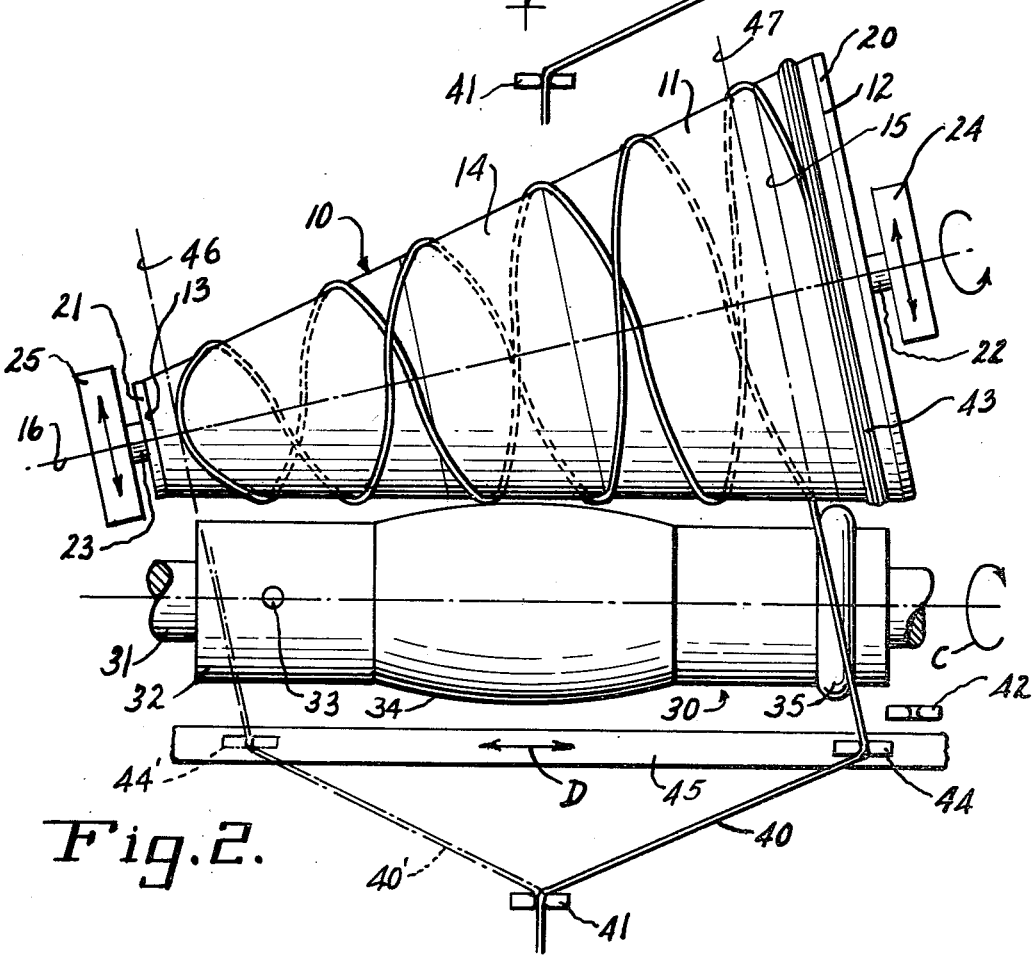
FIG. 2 is an elevation of the core, during the winding of a strand thereon in helical fashion, in relation to the drive therefor.

While the core 10 is driven by the drive surface 35, a strand 40, delivered from a supply (not shown) of said strand through fixed guide 41 and a fixed open-sided guide 42, is wound as a creeling tail 43 in a narrow band near the large end 12 of the core and to either side of line 15. Because the core is driven by drive surface 35 at this time, the peripheral speed of the core at the creeling tail is lower than if drive surface 34 were driving the core. The creeling tail winding speed, being the same as the peripheral speed of the core where the creeling tail is being wound, is thus also reduced, resulting in a constant reduced tension in the strand. When the creeling tail is completed, the strand 40 is moved from fixed guide 42 to an open-sided traversing guide 44, movable back and forth in the directions of arrows D, as by a reciprocating rod 45, to wind a helix between limits 46, 47 on the conical surface 11 of the rotating core 10, as seen in FIG. 2. The limit 46 is closely adjacent to the small end 13, and limit 47 is closely adjacent to whichever of contact line 15 or creeling tail 43 is closest to the small end. As shown, line 15 is closest. As strand 40, being helically wound, approaches contact line 17, it becomes pinched between the core 10 and the drive surface 34, lifting the core out of engagement with both drive surfaces 34, 35. This lifting of the core disengages the frictional drive between drive surface 35 and the core, and transfers it to drive surface 34 in frictional engagement with strand 40, which, in turn, is in frictional engagement with core 10. The line of contact between the drive surface 34 and strand 40 wound on core 10 shifts with the location of the pinched portion of the strand along the helix.

It is the locations of the first and last pinched portions of the helically wound strand 40 that determines the limits of medial portion 14. Until there is always at least one strand pinched between the core and the raised annular surface 34, the core drive will be transferred back and forth between raised annular surfaces 34, 35, creating a fluctuating winding rate, which is undesirable. In order to reduce this fluctuation to a minimum, the width of the raised annular surface 34 should be broad enough to pinch some portion of the strand during each complete revolution of the core. Since, however, the rotational speed is proportional to the radius from axis 16 to the point of contact with drive surface 34, the rotational speed will vary in an amount proportional to the width of medial portion 14, when the core is being rotated by drive surface 34. For this reason, it may be desirable to limit the width of the medial portion to somewhat less than the pitch of the helical angle. In order to reduce slippage and resultant scuffing of the core 10 and strand 40, the drive surface 34 is curved along its length in order to limit the area of contact. The radius of curvature R should be large enough to permit pinching of some portion of the strand during a substantial portion of each complete revolution of the core. In contrast, the drive surface 35 should be narrow to maximize the amount of strand 40 that may be wound on the core 10 and the drive surface should be curved to reduce the area of contact with the core and thus reduce scuffing. For this reason an O-ring with a circular cross-section is preferred. Combining these desirable features the drive surface 35 could be formed by an O-ring with a small circular cross-section, limited by the desired height above the surface of sleeve 32 and the minimum depth of locating groove 36.

A cone winder of the type described (aside from the new frictional drive at the large end 12) is well-known and is customarily used with a tension control device between the strand supply (not shown) and the traversing guide 44. Many such tension controls are known in the art. It is also necessary to employ a tension control with this improved dual drive cone winder, if the tension on the strand is to be controlled.

Although the outer diameters of the drive surfaces 34, 35 are equal in the embodiment described, there is no such requirement, and, while specific materials for the cone 10 and the drive surfaces were mentioned, they are not essential. It is necessary that the materials from which the annular surfaces are made have an adequate coefficient of friction when used in combination with the material of the core 10, that the drive surface 34, adjacent the medial portion 14 of the core, does not seriously abrade the core or the strand, and that the torque produced on the core by this drive mechanism 30 at the end portion 15 exceed the torque produced at the medial portion 14.

I claim:

1. A method for winding a strand upon a conical package core, comprising the steps of rotating said core and the package wound thereon through a frictional engagement only with at least one segment of said strand overlying a medial portion of the conical surface of said core during the helical winding of said strand thereon, and characterized by frictionally engaging and rotating said core at an end portion of the conical surface near the large end of said core while winding a creeling tail in a narrow band on said core near the end portion, helically winding said strand on said core including the medial portion thereof, and employing said strand wound over the medial portion to automatically lift said core, thereby removing the end portion from said frictional engagement.

2. Apparatus for helically winding a strand upon a conical package core having an axis, an annular medial portion intermediate the ends of said core on the conical surface thereof and an annular end portion near the large end of said core on the conical surface thereof, said apparatus comprising a frictional drive for rotating said core, means for supporting said core in such a manner as to permit free rotation of said core about the axis and to permit lateral movement of said core toward and away from said core-rotating drive, said drive comprising a rotatable drive shaft, a first raised annular drive surface affixed concentric on the shaft in a position to engage only those segments of said strand overlying the medial portion of the core, and characterized by a second raised annular drive surface affixed concentric on the shaft in a position to engage only the end portion of the bare core, whereby said second drive surface is effective to rotate said core until the strand overlying the medial portion engages the first annular drive surface and thereby lifts the core and the end portion thereof out of engagement with said second drive surface and transfers core-rotation to said first drive surface in engagement with said strand.

3. Apparatus according to claim 2 wherein the outside diameters of the first and second drive surfaces are substantially equal.

4. Apparatus according to claim 2 wherein said second drive surface is narrow.

5. Apparatus according to claim 4 wherein said second drive surface is formed by an O-ring located in a groove in said drive shaft.

6. Apparatus according to claim 5 wherein said O-ring has a circular cross-section.

7. Apparatus according to claim 2 wherein said first drive surface is broad.

8. Apparatus according to claim 7 wherein said first drive surface has a large radius of curvature along its length.

9. Apparatus according to claim 2 wherein an open-sided fixed guide controls the disposition of said strand on the conical surface of said core as a creeling tail is wound in a narrow band near said end portion.

10. Apparatus according to claim 9 wherein said creeling tail is located between said end portion and the large end of said core.

* * * * *